US006199727B1

(12) United States Patent
Suh

(10) Patent No.: US 6,199,727 B1
(45) Date of Patent: Mar. 13, 2001

(54) APPARATUS FOR BINDING THREAD RUNNING THROUGH BUTTON SEWED ON GARMENT

(76) Inventor: Myung Won Suh, 425-5, Han Yang 203, Sin Wol-dong, Yang Chun-gu, Seoul 158-094 (KR)

( * ) Notice: Subject to any disclaimer, the term of this patent is extended or adjusted under 35 U.S.C. 154(b) by 0 days.

(21) Appl. No.: 09/423,717

(22) PCT Filed: May 30, 1998

(86) PCT No.: PCT/KR98/00137

§ 371 Date: Nov. 12, 1999

§ 102(e) Date: Nov. 12, 1999

(87) PCT Pub. No.: WO98/54391

PCT Pub. Date: Dec. 3, 1998

(30) Foreign Application Priority Data

May 31, 1997 (KR) ..... 97-22419
May 26, 1998 (KR) ..... 98-19024

(51) Int. Cl.[7] ..... A41M 43/00
(52) U.S. Cl. ..... 223/1; 112/110; 112/108
(58) Field of Search ..... 223/1; 2/265; 112/108, 112/110

(56) References Cited

U.S. PATENT DOCUMENTS 2,013,449 * 9/1935 Sibbald ..... 112/110
4,161,148 7/1979 Bakhalov et al. .
4,712,493 12/1987 Aso et al. .
4,884,517 12/1989 Asao et al. .
5,082,151 * 1/1992 Schaerer ..... 223/1
5,092,256 3/1992 Kojima .
6,029,867 * 2/2000 Lee ..... 223/1

* cited by examiner

*Primary Examiner*—Bibhu Mohanty
(74) *Attorney, Agent, or Firm*—McDermott, Will & Emery

(57) ABSTRACT

An apparatus for binding a button-fixing thread running through a button sewed on a garment or other fabric, which is capable of winding a binding thread around the button-fixing thread by several turns in a safe, simple, easy and convenient manner while forming a twist with the binding thread at every turn, thereby not only preventing the button from being separated due to a loosening of the button-fixing thread during a strong washing operation or an operation of passing the button through a button slit formed in the garment, but also achieving an improvement in the binding operation and an improvement in the reliability in use. The apparatus includes a thread hooking plate adapted to hook a binding thread to be wound around a button-fixing thread, a twisting member adapted to twist the binding thread hooked by the thread hooking plate and to separate the twisted binding thread from the thread hooking plate after the thread hooking plate rotates by a predetermined angle, and a twist forming member fixedly mounted to an end of the second actuating shaft disposed in the vicinity of the twisting member, the twist forming member adapted to hook the binding thread twisted by the twisting member after the twisting member rotates by a predetermined angle, thereby forming a complete twist with the binding thread.

9 Claims, 12 Drawing Sheets

APPARATUS FOR BINDING THREAD RUNNING THROUGH BUTTON SEWED ON GARMENT

BACKGROUND OF THE INVENTION

1. Field of the Invention

The present invention relates to an apparatus for winding a binding thread around a button-fixing thread running through a button sewed on a garment, such as a coat, shirt, blouse, or jacket, in order to prevent the button-fixing thread from being loosened. More particularly, the present invention relates to an apparatus for binding a button-fixing thread running through a button sewed on a garment or other fabric, which is capable of winding a binding thread around the button-fixing thread by several turns in a safe, simple, easy and convenient manner while forming a twist with the binding thread at every turn, thereby not only preventing the button from being separated due to a loosening of the button-fixing thread, but also achieving an improvement in the binding operation and an improvement in the reliability in use.

2. Description of the Prior Art

Generally, buttons are used for garments in order to provide convenience in putting-on and taking-off of those garments. Such buttons are provided with button holes having a desired shape so that they are sewed on a garment in a convenient and rapid manner. It is very inefficient to manually carry out such a button attachment operation in fields where garments are manufactured in a mass production fashion. To this end, button sewing machines are used in such fields in order to rapidly carry out a button sewing operation for a large number of buttons, thereby achieving an improvement in workability and productivity.

Such button sewing machines operate to reciprocally run a thread through the holes of a button and a garment to be attached with the button by use of a needle, thereby fixing the button to the garment. In this case, however, the space between the button and the fabric is very small. As a result, it is very difficult to pass the button through a button slit formed in the garment upon putting on the garment.

In other words, there is inconvenience in attaching the button to the fabric because the button is sewed on the fabric while leaving an insufficient space therebetween. Furthermore, since the sewing of the button is achieved by reciprocally running a single strand of a button-fixing thread through the holes of the button and the fabric in a zig-zag fashion, the button is easily loosened from the fabric when the button-fixing thread becomes unknotted. Thus, this method is problematic in that the button is insecurely attached to the fabric.

In order to achieve an attachment of a button to a fabric enabling the button to more conveniently pass through a button slit formed in the fabric, a method, which is illustrated in FIG. 11, has been proposed. In accordance with this method, a binding thread 3 is tightly wound around a button-fixing thread 2 reciprocally running through the holes of a button 1 and a fabric, thereby spacing the button 1 from the fabric by a desired distance. Accordingly, it is possible not only to prevent the button 1 from being separated from the fabric due to a loosening of the button-fixing thread, but also allowing the button 1 to easily pass through a button slit formed in the fabric. In this case, however, the binding thread 3 is simply wound around the button-fixing thread 2. For this reason, the binding thread 3 may be loosened after the fabric is subjected to a strong washing operation in a washing machine. This may result in an early loosening of the button-fixing thread. In order to eliminate this problem, another method has recently been proposed in which a binding thread made of an elastic material such as Nylon yarn is used. In accordance with this method, the binding thread is tightly wound around a button-fixing thread reciprocally running through the holes of a button and a fabric. At the final stage of the button attachment process, the binding thread is cut at its desired portion under the condition in which a maximum tension is applied to the binding thread, so that the cut end of the binding thread is retracted into the turns of the binding thread, thereby preventing the binding thread from being loosened. However, the tension of the binding thread may be reduced over a lapse of time. Otherwise, the binding thread may be deteriorated in its physical properties. As a result, the binding thread loses its elasticity. This results in a reduction in the fastening force of the binding thread, thereby causing the binding thread to be loosened.

SUMMARY OF THE INVENTION

Therefore, the present invention has been made in view of the above mentioned problems, and an object of the invention is to provide an apparatus for binding a button-fixing thread running through a button sewed on a garment or other fabric, which is capable of winding a binding thread around the button-fixing thread by several turns in a safe, simple, easy and convenient manner while forming a twist with the binding thread at every turn, thereby not only preventing the button from being separated due to a loosening of the button-fixing thread during a strong washing operation or an operation of passing the button through a button slit formed in the garment, but also achieving an improvement in the binding operation and an improvement in the reliability in use.

In accordance with the present invention, this object is accomplished by providing an apparatus for winding a binding thread around a button-fixing thread running through a button sewed on a fabric, comprising: a base die; a motor fixedly mounted on the base die; a first spur gear fixedly mounted on a main rotating shaft coupled to the motor; a driven shaft having a second spur gear fixedly mounted thereon and connected to the first spur gear by a timing belt, the driven shaft also having a third spur gear fixedly mounted thereto, a fourth spur gear fixedly mounted thereto, and a fifth spur gear fixedly mounted thereto; a first actuating shaft connected to the driven shaft, the first actuating shaft being of a hollow structure and having a sixth spur gear fixedly mounted thereon and engaged with the third spur gear; a rotating shaft connected to the driven shaft, the rotating shaft having a seventh spur gear connected to the fourth spur gear by a timing belt; an eccentric cam fixedly mounted on the rotating shaft; a carriage fixedly mounted on the first actuating shaft and operatively connected to the eccentric cam, the carriage serving to convert a rotation of the rotating shaft into an axial reciprocal movement of the first actuating shaft; a drum rotatably mounted on the first actuating shaft; an eighth spur gear rotatably mounted on the first actuating shaft and connected to the fifth spur gear by a timing belt, the eighth spur gear being attached to the drum, thereby rotating the drum upon a rotation of the first actuating shaft; a second actuating shaft axially received in the first actuating shaft, the second actuating shaft being axially fixed with respect to the first actuating shaft while rotating freely; means for reversibly rotating the second actuating shaft; a thread hooking plate attached to the drum opposite to the eighth spur gear at a desired portion of the periphery of the drum and adapted to hook the binding thread to be wound around the button-fixing thread when the drum rotates; a twisting member fixedly mounted to an end of the first actuating shaft protruded from the drum, the twisting member serving to twist the binding thread hooked by the thread hooking plate and to separate the twisted binding thread from the thread hooking plate in accordance with an axial and rotating movement of the first actuating shaft after the thread hooking plate rotates by a predetermined angle; a twist forming member fixedly mounted to an end of the second actuating shaft disposed in the vicinity of the twisting member, the twist forming member serving to hook the binding thread twisted by the twisting member in accordance with an axial and rotating movement of the second actuating shaft after the twisting member rotates by a predetermined angle, thereby forming a complete twist with the binding thread; a thread separating member arranged in the vicinity of the twist forming member, the thread separating member serving to hook the twisted binding thread on the twist forming member after a predetermined period of time corresponding to a predetermined rotation degree of the twist forming member elapses, thereby separating the twisted binding thread from the twist forming member and winding the binding thread on the button-fixing thread; means for reversibly rotating the thread separating member; and a button holding die arranged in front of the drum and configured to rotate while moving axially to allow a button-fixing thread to run reciprocally through a button held by the button holding die and a garment to be attached with the button.

BRIEF DESCRIPTION OF THE DRAWINGS

Other objects and aspects of the invention will become apparent from the following description of embodiments with reference to the accompanying drawings in which:

FIGS. 7*a* to 7*h* are schematic views respectively illustrating a binding operation of the apparatus of FIG. 1, wherein:

FIG. 7*a* shows an initial state for the binding operation,

FIG. 7*b* shows a state in which the thread hooking plate rotates by a ¾ revolution, FIG. 7*c* shows a state in which the twisting member hooks a lower strand of the binding thread, FIG. 7*d* shows a state in which the twisting member rotates by one revolution, FIG. 7*e* shows a state in which the thread separating member rotates to separate the binding thread from the twist forming member, FIG. 7*f* shows a state in which the twisted binding thread is separated from the twist forming member by the thread separating member, FIG. 7*g* shows a state in which the twisted binding thread is separated from the thread separating member, FIG. 7*h* shows the initial state for the binding operation;

FIGS. 8*a* to 8*e* are schematic views illustrating respective states of the binding thread corresponding to the sequential steps of the binding operation, wherein:

FIG. 8*a* shows an initial winding state,

FIG. 8*b* shows a state in which the binding thread is twisted in such a manner that two strands thereof are formed, FIG. 8*c* shows a state preceding to a state in which the binding thread is completely twisted, FIG. 8*d* shows a state in which the binding thread forms a complete twist, and FIG. 8*e* shows a state in which the binding thread is wound on the thread-fixing thread in a twisted state;

DESCRIPTION OF THE PREFERRED EMBODIMENTS

Figure 1:
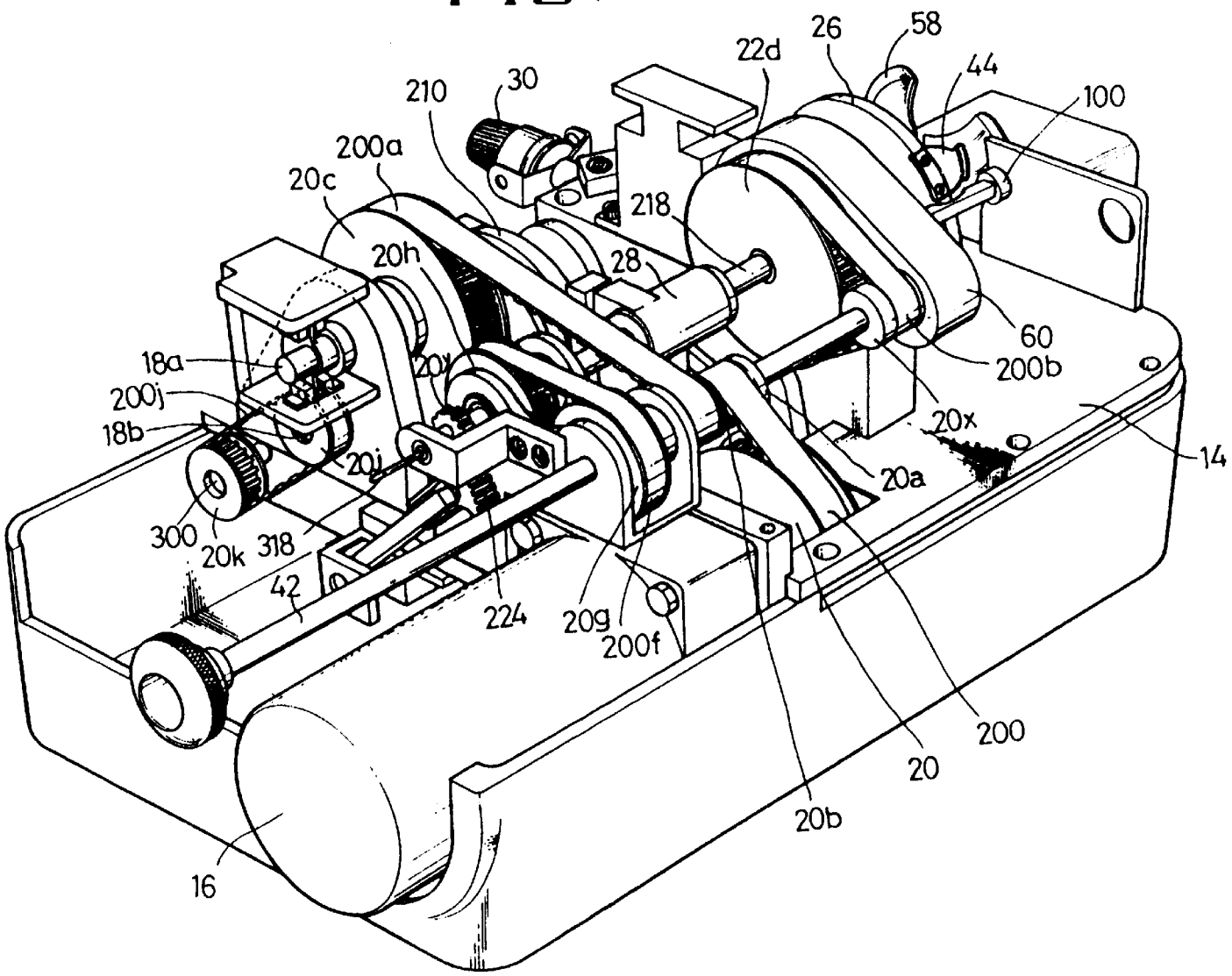
FIG. 1 is a perspective view schematically illustrating a binding apparatus according to the present invention.
Figure 2:
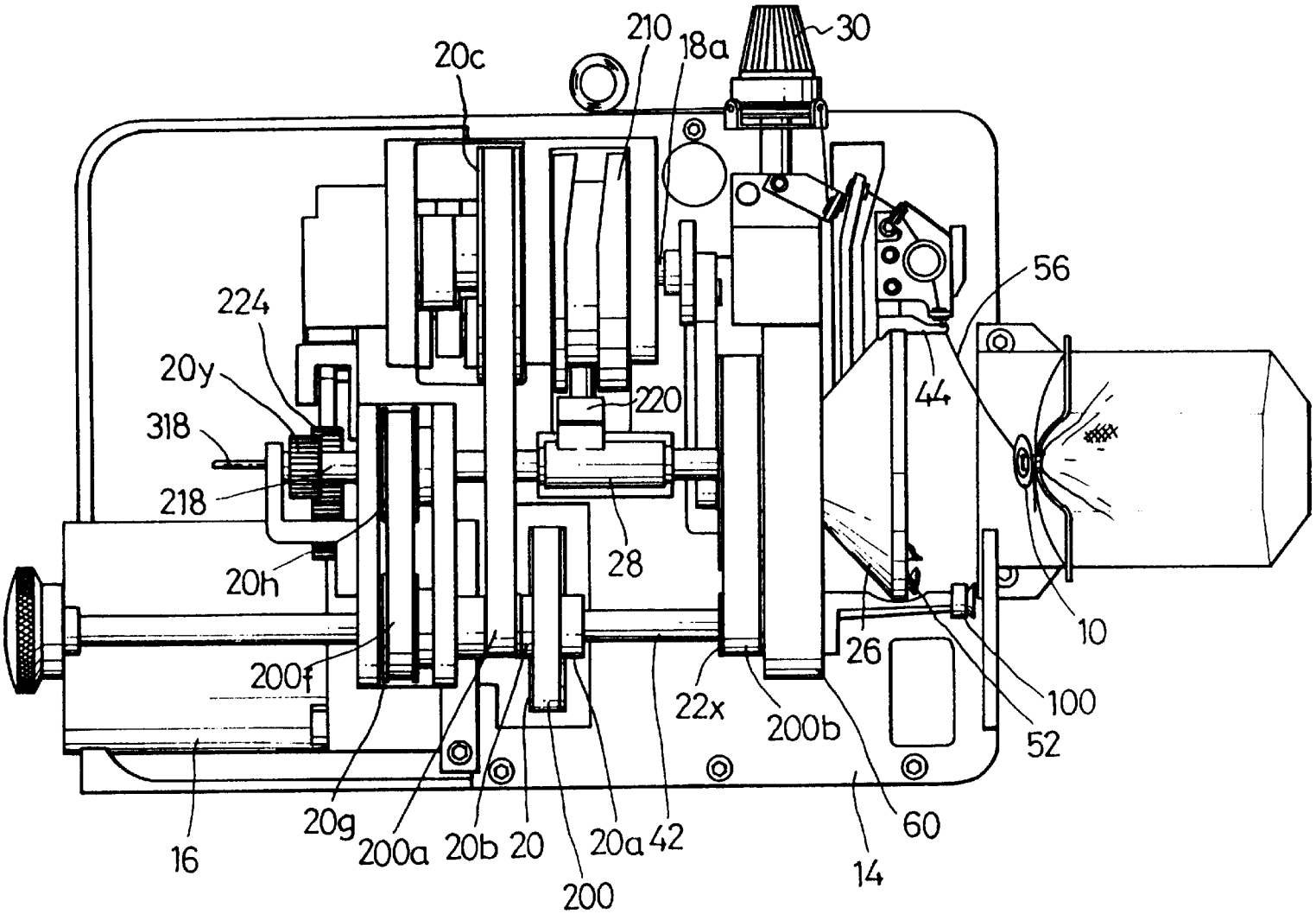
FIG. 2 is a plan view illustrating the apparatus of FIG. 1.
Figure 3:
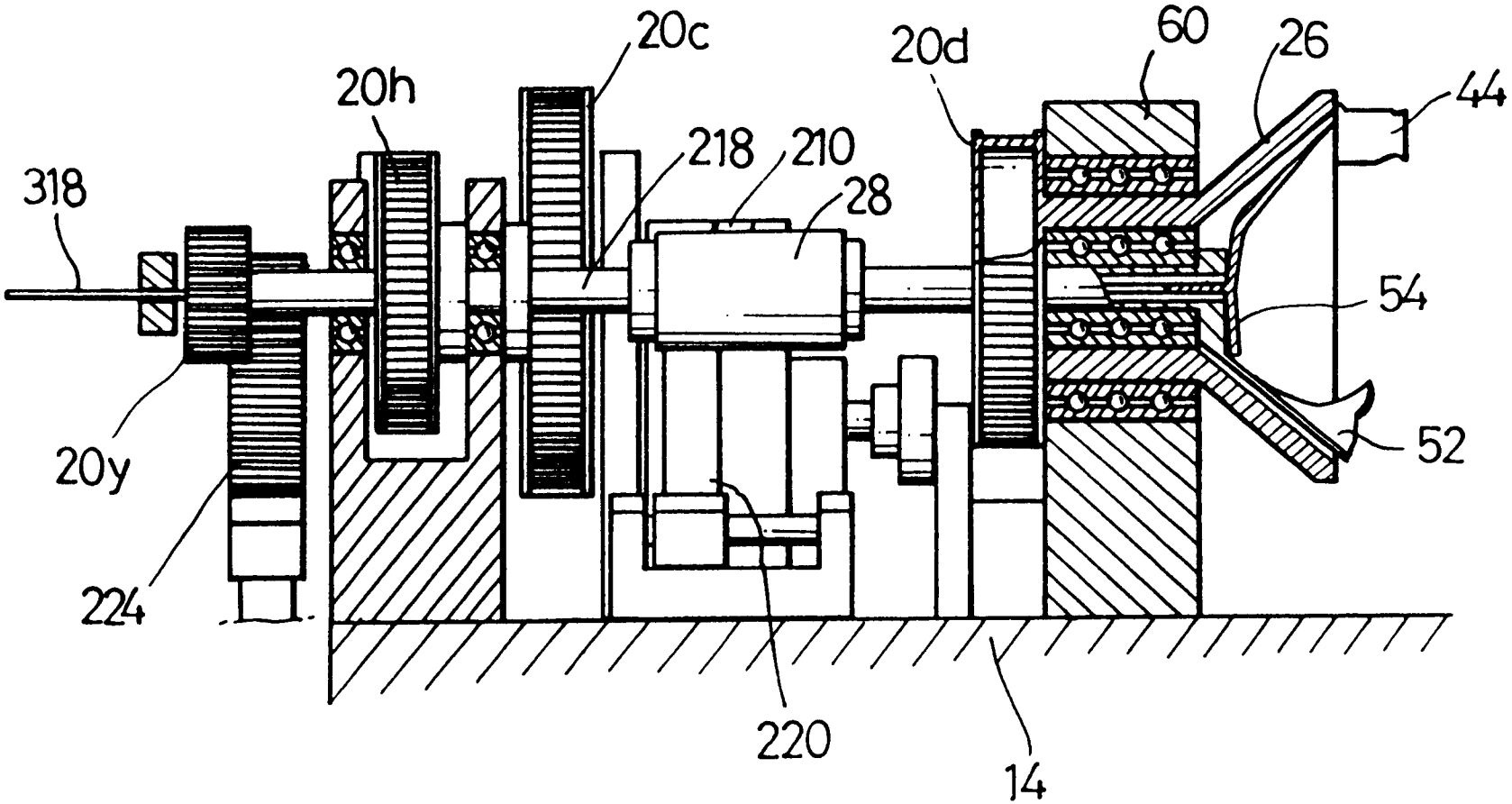
FIG. 3 is a sectional view illustrating rotating shafts and a drum included in the apparatus of FIG. 1.

Referring to FIGS. 1 and 2, an apparatus for binding a button-fixing thread running through a button sewed on a garment or other fabric in accordance with the present invention is illustrated. As shown in FIGS. 1 and 2, the apparatus includes a base die 14, and a motor 16 fixedly mounted on one side portion of the base die 14.The motor 16 is provided with a main rotating shaft which rotates by a drive force of the motor 16. A spur gear 20 is fixedly mounted on the main rotating shaft. Another spur gear 20*a* is connected to the spur gear 20 by a timing belt 200. The spur gear 20*a* is fixedly mounted on a driven shaft 42. Thus, the drive force from the motor 16 is transmitted to the driven shaft 42.

Another spur gear 20*b* is also fixedly mounted on the driven shaft 42. Another spur gear 20*c* is connected to the spur gear 20*b* by a timing belt 200*a*. The spur gear 20*c* is fixedly mounted on a rotating shaft 18*a*. An eccentric cam 210 is fixedly mounted on the rotating shaft 18*a*. Thus, the eccentric cam 210 is driven by the drive force from the motor 16. A carriage 28 is operatively connected to the eccentric cam 210 by a link 220 consisting of two bars pivotally connected to each other. The carriage 28 is fixedly mounted on an actuating shaft 218. The link 220 has a connecting pin 222 engaged with a cam groove formed on the eccentric cam 210. The link 220 is also connected at one end thereof to the carriage 28. Accordingly, the carriage 28 reciprocates axially along with the actuating shaft 218 when the eccentric cam 210 rotates by the drive force of the motor 16. That is, the eccentric cam 210 and carriage 28 serve to convert the rotation of the rotating shaft 18*a* into an axial reciprocal movement of the actuating shaft 218.

Spur gears 20*g* and 20*h*, which are connected to each other by a timing belt 200*f*, are mounted on the driven shaft 42 and actuating shaft 218, respectively. Accordingly, the actuating shaft 218 rotates by the rotating force from the motor 16 transmitted thereto via the driven shaft 42.

In order to transmit the rotating force of the driven shaft 42 to the actuating shaft at a transfer ratio of 1:1, the spur gears 20*g* and 20*h* have a gear ratio of 1:1. That is, the actuating shaft 218 rotates at the same rotation ratio as the driven shaft 42.

Another spur gear 22*d* is rotatably mounted on the actuating shaft 218. The spur gear 22*d* is connected to a spur gear 20*x* fixedly mounted on the driven shaft 42 by a timing belt 200*b*. A drum 26, which is enclosed in a drum casing 60, is rotatably mounted on the actuating shaft 218 and fixedly attached at one end thereof to the spur gear 22*d*. Thus, the drum 26 rotates when the spur gear 22*d* rotates by the drive force of the motor 16. A thread hooking plate 44 is attached to the other end of the drum 26 opposite to the spur gear 22*d* at a desired portion of its periphery. The thread hooking plate 44 has a bent hook portion adapted to hook a binding thread 56 which is supplied from a reel via a thread tension regulator 30. The thread hooking plate 44 hooks the binding thread 56 as the drum 26 rotates through a desired angle. A twisting member 52 is fixedly mounted to the end of the actuating shaft 218 protruded from the drum 26. The twisting member 52 moves axially and rotates as the actuating shaft 218 moves axially and rotates, in order to twist the binding thread 56 while completely separating the binding thread 56 from the thread hooking plate 44.

As mentioned above, the thread hooking plate 44 is bent to provide a desired deviation angle, so that the binding thread 56 has two hooked portions having different axial positions when it is hooked by the thread hooking plate 44.

A thread anti-separation bearing 100 is mounted to the drum 26. The thread anti-separation bearing 100 serves to prevent the binding thread 56 hooked by the thread hooking plate 44 from being separated from the thread hooking plate during the rotation of the thread hooking plate 44 until the twisting member 52 completely hooks the binding thread 56.

Figure 4:
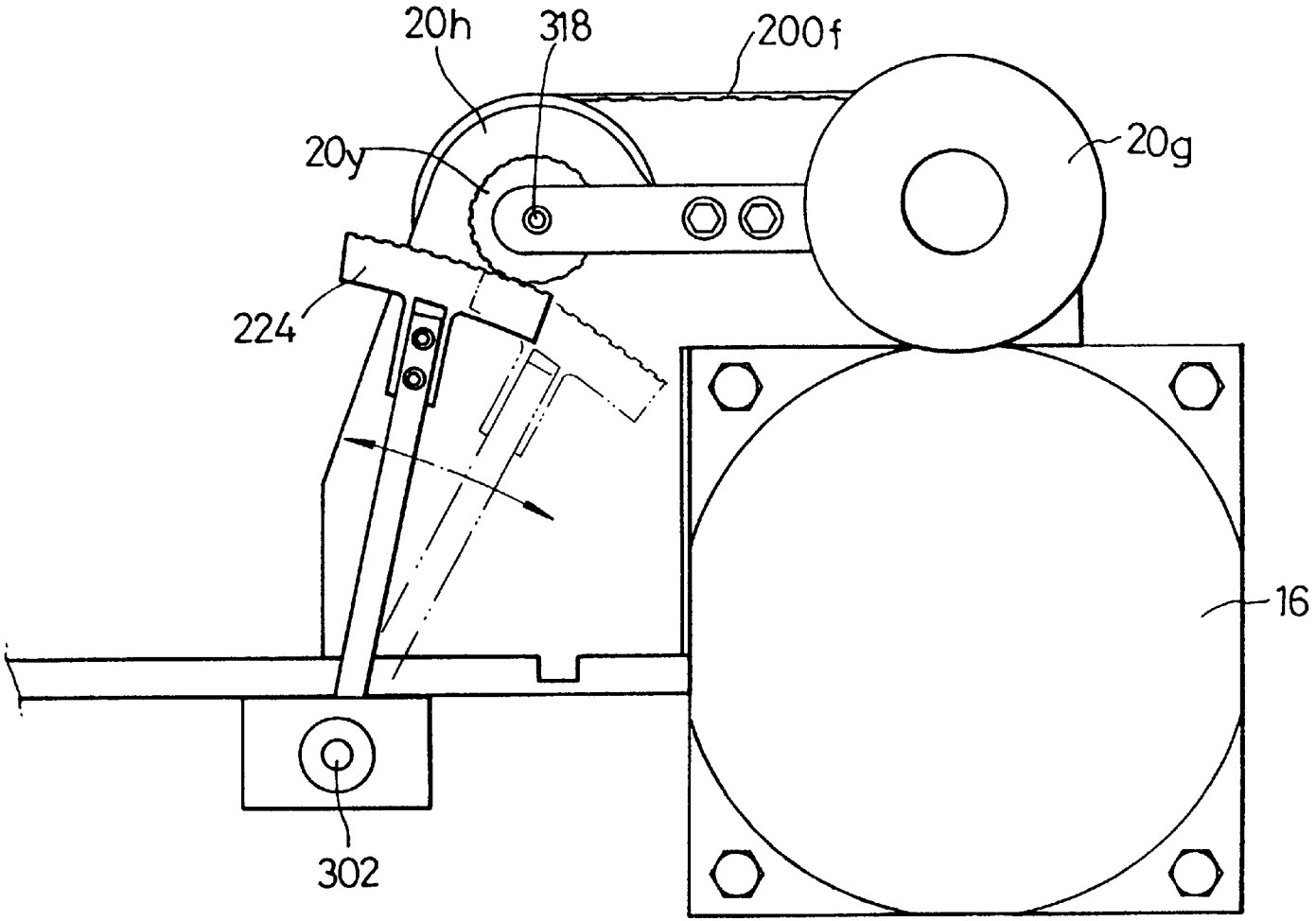
FIG. 4 is a side view illustrating a sector gear and a spur gear engaged with the sector gear, which are included in the apparatus of FIG. 1.

The actuating shaft 218 has a hollow structure in order to fit an actuating shaft 318 therein. The actuating shaft 318 is axially received in the actuating shaft 218 while being axially fixed with respect to the actuating shaft 218 so that it reciprocates axially together with the actuating shaft 218. A spur gear 20*y* is fixedly mounted on a portion of the actuating shaft 318 protruded from the end of the actuating shaft 218 opposite to the drum 26, in order to rotate the actuating shaft 318. As best shown in FIG. 4, a sector gear 224 is engaged with the spur gear 20*y*. The sector gear 224 is configured to rotate reversibly through a desired angle, thereby causing the spur gear 20*y* and its actuating shaft 318 to rotate reversibly. A twist forming member 54 is fixedly mounted to the end of the actuating shaft 318 opposite to the spur gear 20*y*. The twist forming member 54 rotates reversibly as the actuating shaft 318 rotates reversibly.

A thread separating member 214 is arranged in the vicinity of the twist forming member 54. The thread separating member 214 hooks the twisted binding thread 56 on the twist forming member 54 after a predetermined period of time corresponding to a predetermined rotation degree of the twist forming member 54 elapses, thereby separating the twisted binding thread 56 from the twist forming member 54 and winding the binding thread 56 on a button-fixing thread running through a button sewed on a garment. A button holding die 58 is arranged in front of the drum 26. The button holding die 58 is configured to rotate while moving axially to allow a button-fixing thread 12 to run reciprocally through the button holes of a button held by the button holding die 58 and a garment to be attached with the button.

A rotating shaft 18*b* is connected to the spur gear 20*c*. A spur gear 20*j* is fixedly mounted on the rotating shaft 18*b*. A spur gear 20*k* is connected to the spur gear 20*j* by a timing belt 200*j*. The spur gear 20*k* is fixedly mounted to an assistant rotating shaft 300. A pair of eccentric cams 212 are also fixedly mounted on the assistant rotating shaft 300. Accordingly, the eccentric cams 212 rotate as the driven shaft 42 rotates.

The eccentric cams 212 rotates at the same rotation ratio as the driven shaft 42. When the eccentric cams 212 are configured to reversibly rotate the reversible drive shaft 302 through a desired angle. The eccentric cams 212 also serve to move the thread separating member 214 after a predetermined period of time corresponding to a predetermined rotation degree of the twist forming member 54 elapses.

Figure 5:
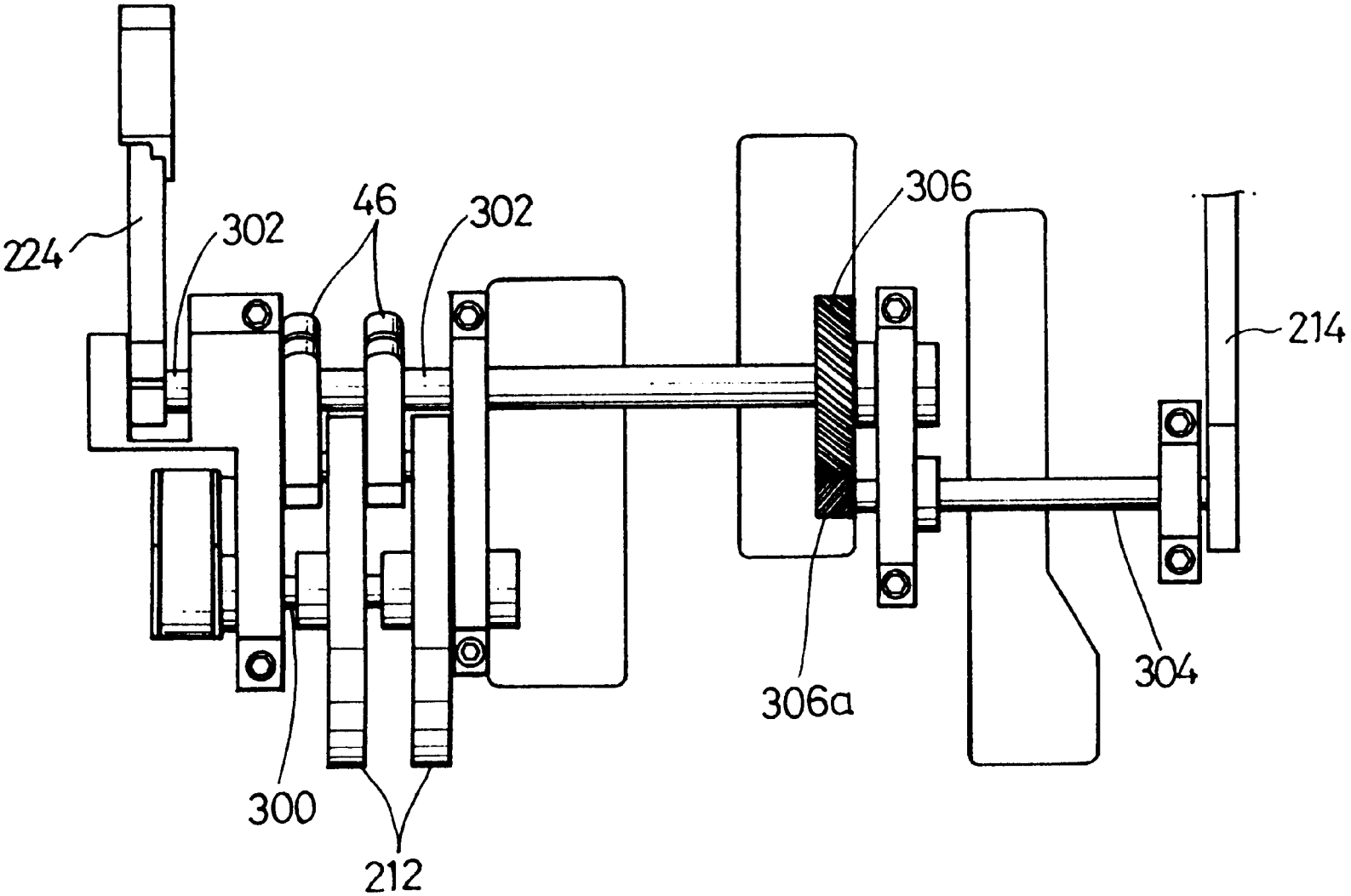
FIG. 5 is a bottom view illustrating a thread separating member and its drive unit, which are included in the apparatus of FIG. 1.
Figure 6:
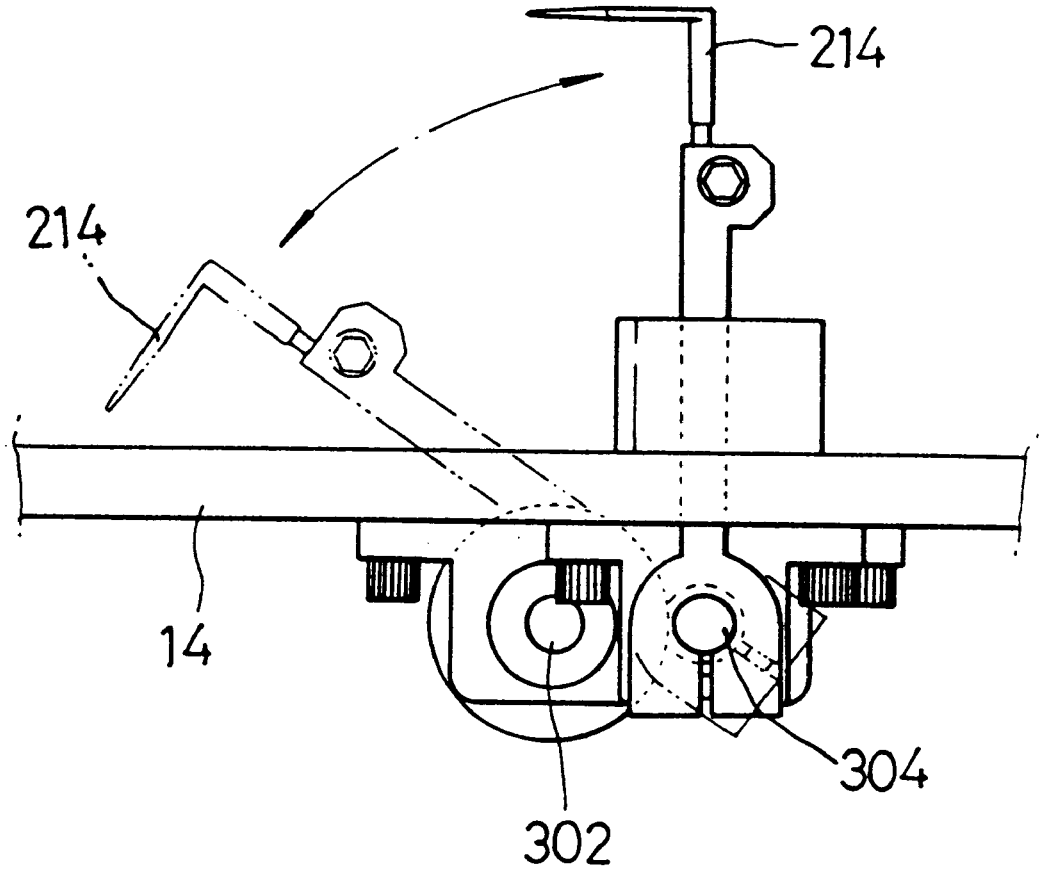
FIG. 6 is a side view illustrating an operation of the thread separating member.

As shown in FIG. 5, connecting members 46 are operatively connected to the eccentric cams 212 so that they carry out an eccentric movement while performing a reversible rotation through a desired angle by virtue of the function of the eccentric cams 212. The connecting members 46 are fixedly mounted to separate portions of a reversible drive shaft 302, respectively. One of the connecting member 46 (namely, the left connecting member in FIG. 5) serves to reversibly rotate the sector gear 224 fixedly mounted on one portion of the reversible drive shaft 302 whereas the other connecting member 46 (namely, the right connecting member in FIG. 5) serves to reversibly rotate a helical gear 306 fixedly mounted on the other portion of the reversible drive shaft 302. Another helical gear 306*a* is engaged with the helical gear 306. The helical gear 306*a* is fixedly mounted on one end of an assistant reversible drive shaft 304. The thread separating member 214 is fixedly mounted to the other end of the assistant reversible drive shaft 304.

The helical gears 306 and 306*a* have a gear ratio capable of obtaining an increased rotation speed of the thread separating member 214.

The spur gear 20 mounted on the main rotating shaft of the motor 16 and the spur gear 20*a* mounted on the driven shaft 42, which are connected to each other by the timing belt 200, have a gear ratio of 3:1. Meanwhile, the spur gear 22*d* rotatably mounted on the actuating shaft 218 and the spur gear 20*x* mounted on the driven shaft 42, which are connected to each other by the timing belt 200*b*, have a gear ratio of 1:4.

Now, the operation of the apparatus having the above mentioned configuration will be described.

When electric power is supplied to the motor 16, thereby rotating the motor 16, the main rotating shaft rotates. By the rotation of the main rotating shaft, the spur gear 20 mounted on the main rotating shaft rotates, so that the driven shaft 42 rotates by a rotation of the spur gear 20*a* connected to the spur gear 20 via the timing belt 200.

The rotation of the driven shaft 42 results in a rotation of the actuating shaft 218 because the actuating shaft 218 is connected to the driven shaft 42 by the spur gears 20*g* and 20*h* and the timing belt 200*f*. Since the spur gears 20*g* and 20*h* have a gear ratio of 1:1, it rotates by the rotating force from the motor 16 transmitted thereto via the driven shaft 42 at the same rotation ratio as the driven shaft 42.

As the actuating shaft 218 rotates, the twisting member 52 rotates to carry out a twisting operation for the binding thread 56 as mentioned hereinafter.

The rotating force of the driven shaft 42 is also transmitted to the rotating shaft 18*a* via the spur gears 20*c* and 20*b* connected by the timing belt 200*a*, so that the rotating shaft 18*a* rotates. The rotation of the rotating shaft 18*a* results in a rotation of the rotating shaft 18*b* connected to the spur gear 20*c* of the rotating shaft 18*a*. As a result, the assistant rotating shaft 300 rotates because it is connected to the rotating shaft 18*b* via the spur gears 20*j* and 20*k* connected by the timing belt 200*j*. According the eccentric cams 212 mounted on the assistant rotating shaft 300 rotate. As the eccentric cams 212 rotate, a reversible rotation of the thread separating member 214 is carried out. The rotation of the eccentric cams 212 also results in a reversible rotation of the actuating shaft 318.

That is, when the eccentric cams 212 rotate, the connecting members 46 coupled to the eccentric cams 212 rotate reversibly through a desired angle, respectively. As a result, two separate portions of the reversible drive shaft 302 rotate reversibly which are connected to the connecting members 46, respectively. Accordingly, the sector gear 224 fixedly mounted on one portion of the reverse drive shaft 302 rotates reversibly. Also, the helical gear 306 fixedly mounted on the other portion of the reverse drive shaft 302 rotates reversibly.

Since the spur gear 20*y* fixedly mounted on the actuating shaft 318 is engaged with the sector gear 224, the reversible rotation of the sector gear 224 results in a reversible rotation of the actuating shaft 318, thereby causing the twist forming member 54 to rotate reversibly through a desired angle. Thus, a twist forming operation is carried out.

The reversible rotation of the helical gear 306 results in a reversible rotation of the reversible drive shaft 304 because the helical gear 306*a* fixedly mounted on one end of the assistant reversible drive shaft 304 is engaged with the helical gear 306. Accordingly, the thread separating member 214 mounted on the other end of the assistant reversible drive shaft 304 rotates reversibly. Meanwhile, the rotation of the rotating shaft 18*a* results in an axial slide movement of the actuating shaft 218. That is, when the rotating shaft 18*a* rotates, the eccentric cam 210 fixedly mounted thereon rotates. Since the carriage 28 fixedly mounted on the actuating shaft 218 is operatively connected to the eccentric cam 210 by the link 220, it reciprocates axially along with the actuating shaft 218 when the eccentric cam 210 rotates. As a result, an axial reciprocal movement of the actuating shaft 218 is carried out. As the actuating shaft 218 carries out the axial reciprocal movement along with the above mentioned reversible rotation, the twisting member 52 carries out a twisting operation for the binding thread 56.

On the other hand, the rotation of the driven shaft 42 also results in a rotation of the drum 26 because the spur gear 22*d* attached to the drum 26 while being rotatably mounted on the actuating shaft 218 is engaged with the spur gear 20*x* fixedly mounted on the driven shaft 42.

An operation of the above mentioned apparatus for winding the binding thread 56 around a button-fixing thread running through a button sewed on a fabric in accordance with the present invention will now be described in conjunction with FIGS. 7*a* to 7*h*.

Figure 7A:
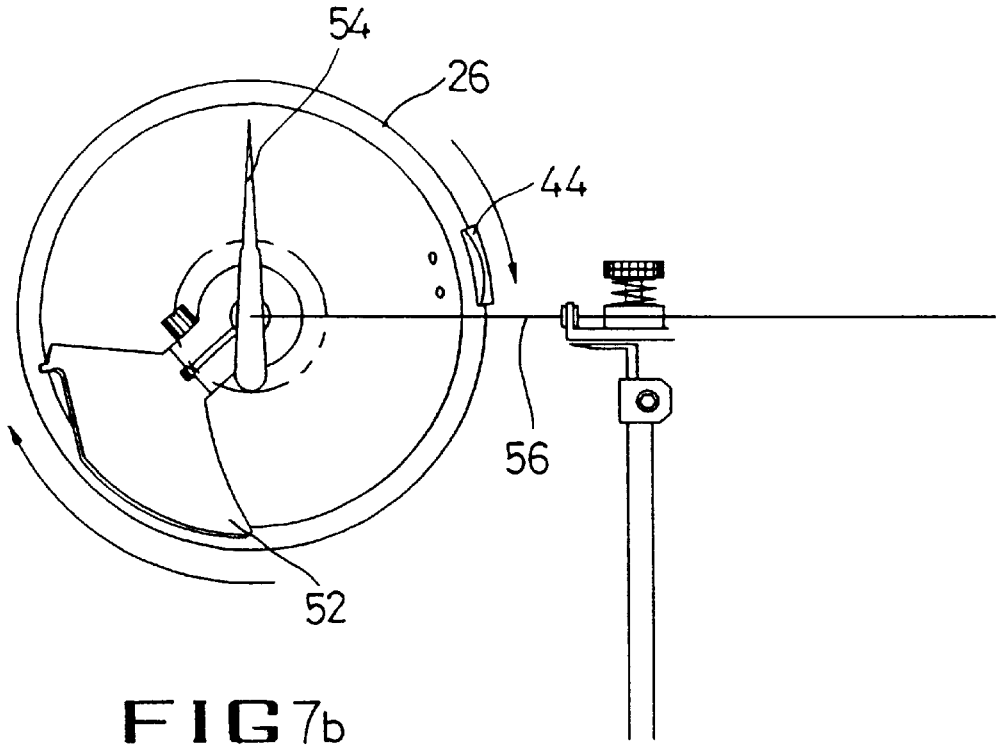
Figure 7B:
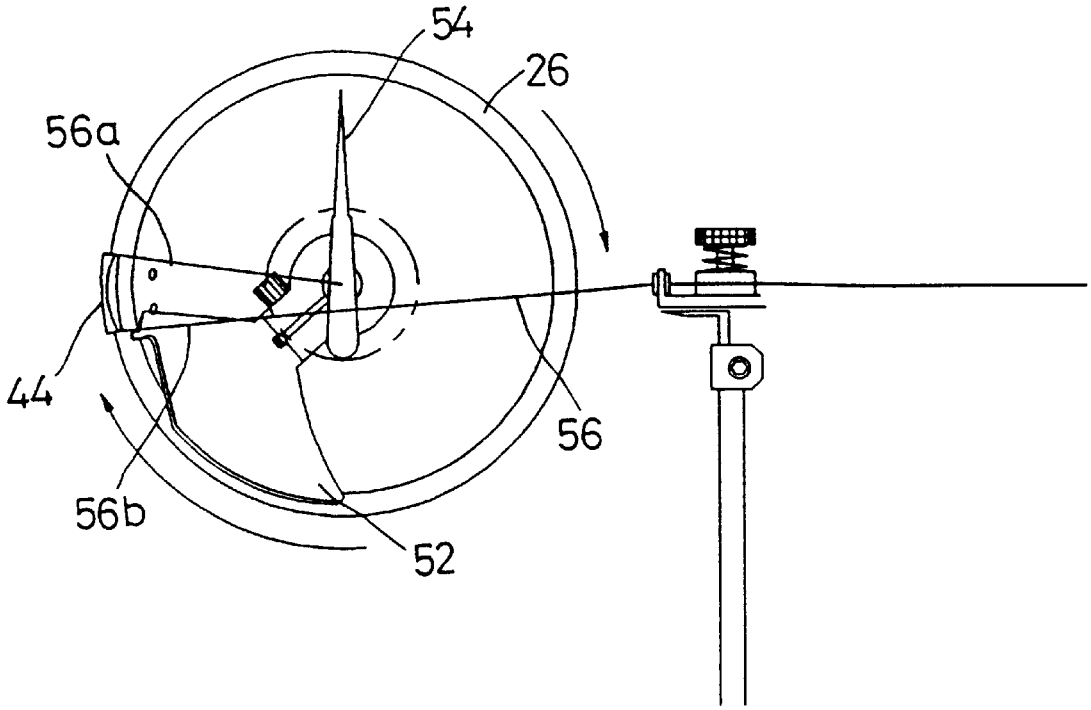
Figure 7C:
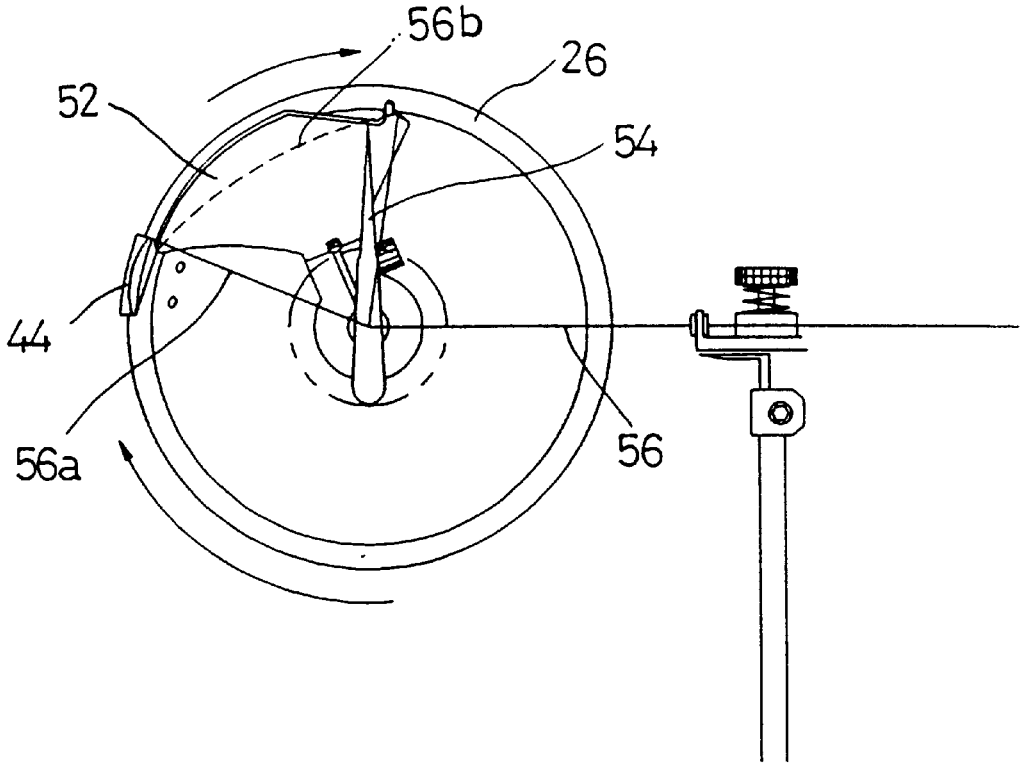
Figure 7D:
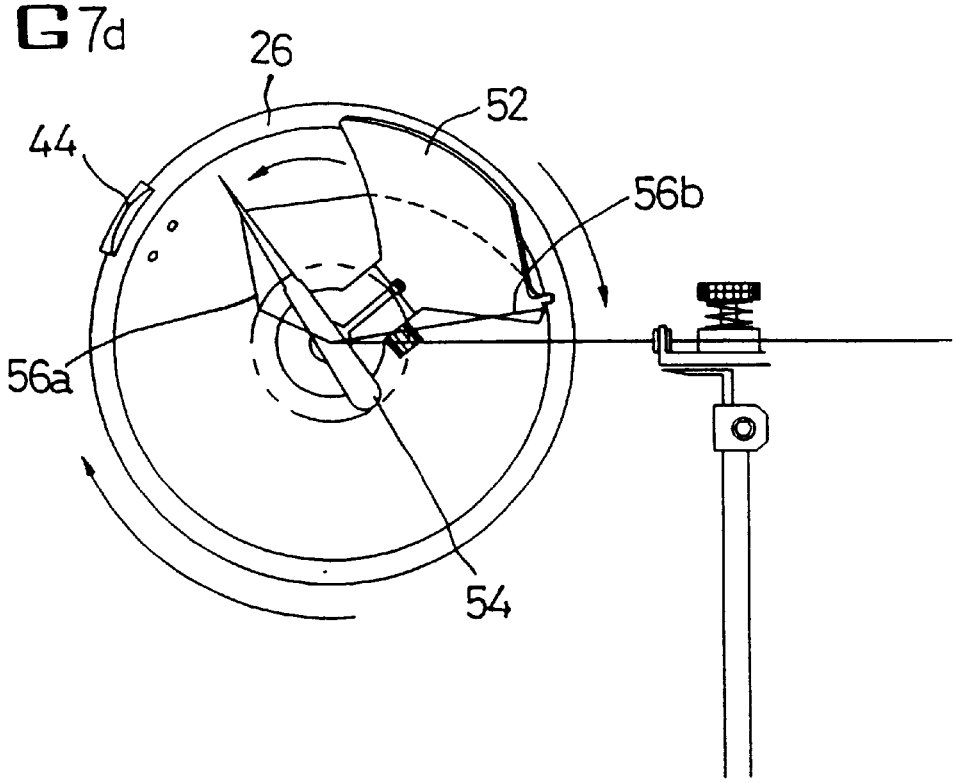

In this operation, a thread hooking operation for hooking the binding thread 56 to be wound on the button-fixing thread is first carried out by the thread hooking plate 44 mounted on the drum 26. That is, when the drum 26 rotates in one direction, namely, clockwise, under the condition in which the button holding die 58 holds the button 10 attached to the fabric 62 while exposing the button-fixing thread 12 running between the button 10 and fabric 62, the thread hooking plate 44 first reaches the binding thread 56 fed from the reel via the thread tension regulator 30, as shown in FIG. 7*a*. As the drum 26 further rotates, the thread hooking plate 44 hooks the binding thread 56. When the thread hooking plate 44 rotates by an angle of 180□ to 270□ (within a ¾ revolution) while hooking the binding thread 56, a state of FIG. 7*b* is obtained. That is, two strands 56*a* and 56*b* the binding thread 56 hooked by the thread hooking plate 44 are positioned in the vicinity of the twisting member 52. Since the thread hooking plate 44 is bent to provide a desired deviation angle, the two hooked strands 56*a* and 56*b* of the binding thread 56 have different axial positions in such a fashion that only the lower strand 56*b* of the binding thread 56 is hooked by the twisting member 52. Accordingly, when the twisting member 52 rotates in the same direction as the drum 26, namely, clockwise, in accordance with a corresponding rotation of the actuating shaft 218, it hooks only the lower strand 56*b* of the binding thread 56 at its leading end, thereby twisting the binding thread 56. As the twisting member 52 further rotates until the strand 56*b* of the binding thread 56 hooked by the leading end of the twisting member 52 moves beyond the twist forming member 54, it also hooks the strand 56*b* of the binding thread 56 at its trailing end while separating the binding thread 56 from the thread hooking plate 44, as shown in FIG. 7*c*. The state of FIG. 7*c* corresponds to a state just preceding the formation of a complete twist with the binding thread 56. After the state of FIG. 7*c*, a rotation of the twist forming member 54 is initiated. Simultaneously, the actuating shaft 218 carries out an axial movement by virtue of the function of the eccentric cam 210. The rotation of the twist forming member 54 is carried out in a reverse direction to that of the drum 26. As mentioned above, this rotation of the twist forming member 54 results from a corresponding rotation of the actuating shaft 318 carried out by a transmission of a rotating force of the sector gear 224 via the spur gear 20*y*. Simultaneously, the twist forming member 54 moves axially because the actuating shaft 318 is axially fixed to the actuating shaft 218. As a result, the twist forming member 54 hooks the strand 56*a* of the binding thread 56, thereby forming a complete twist with the binding thread 56, as shown in FIG. 7*d*.

Figure 7E:
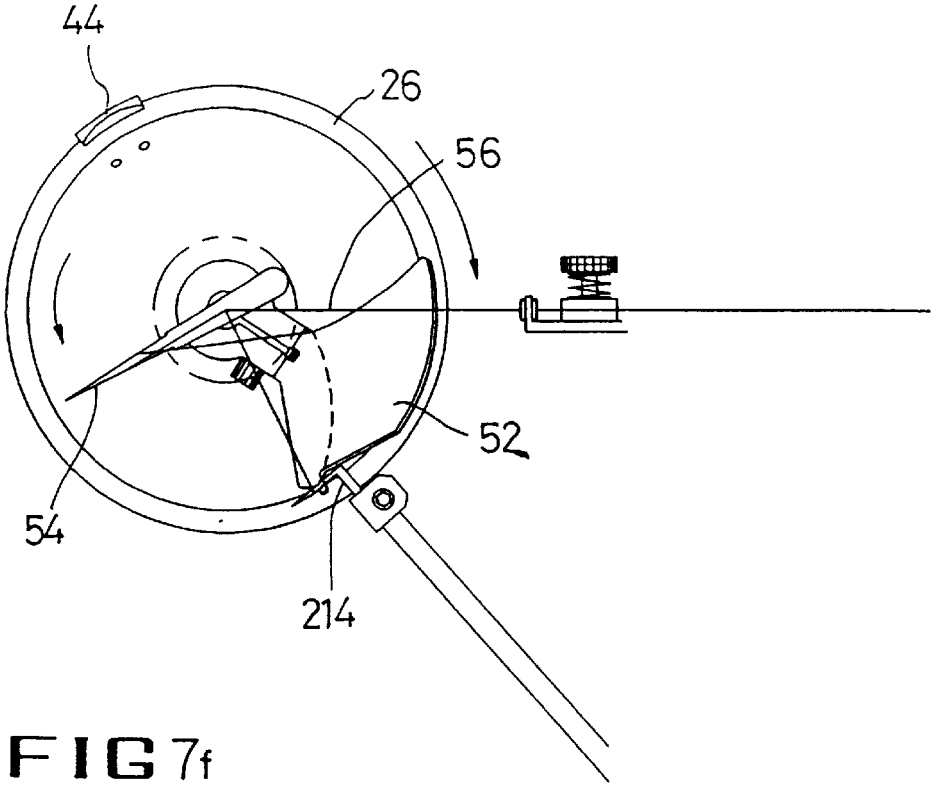
Figure 7F:
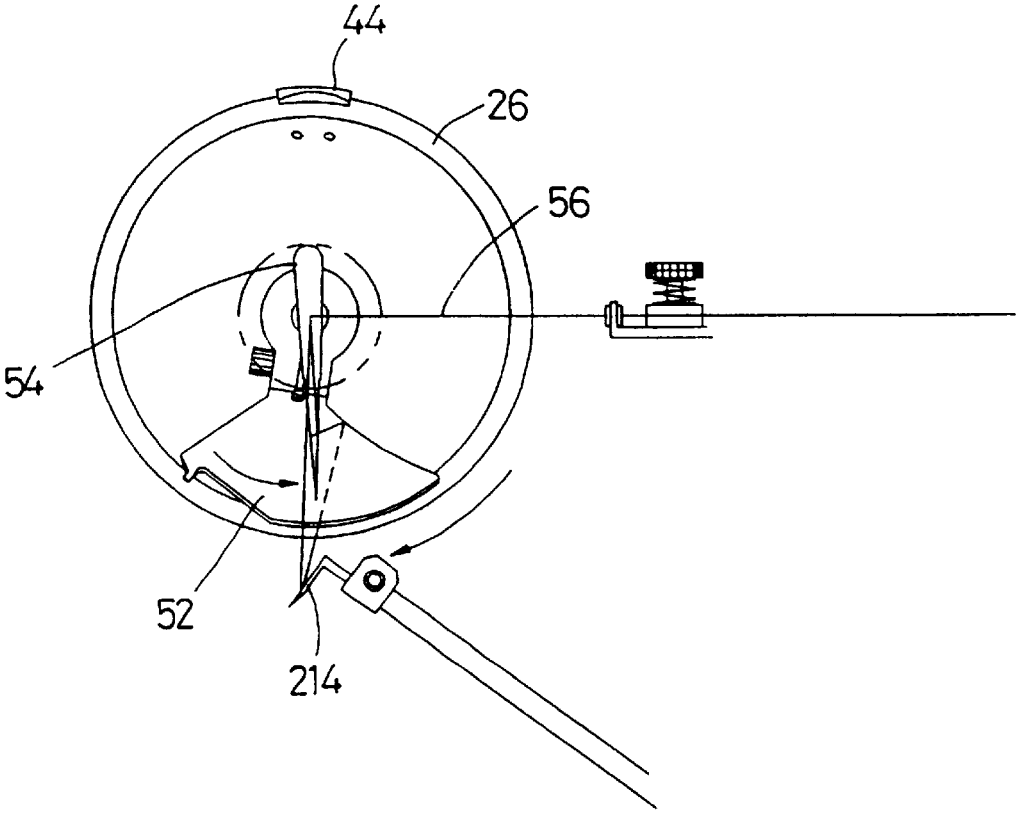
Figure 7G:
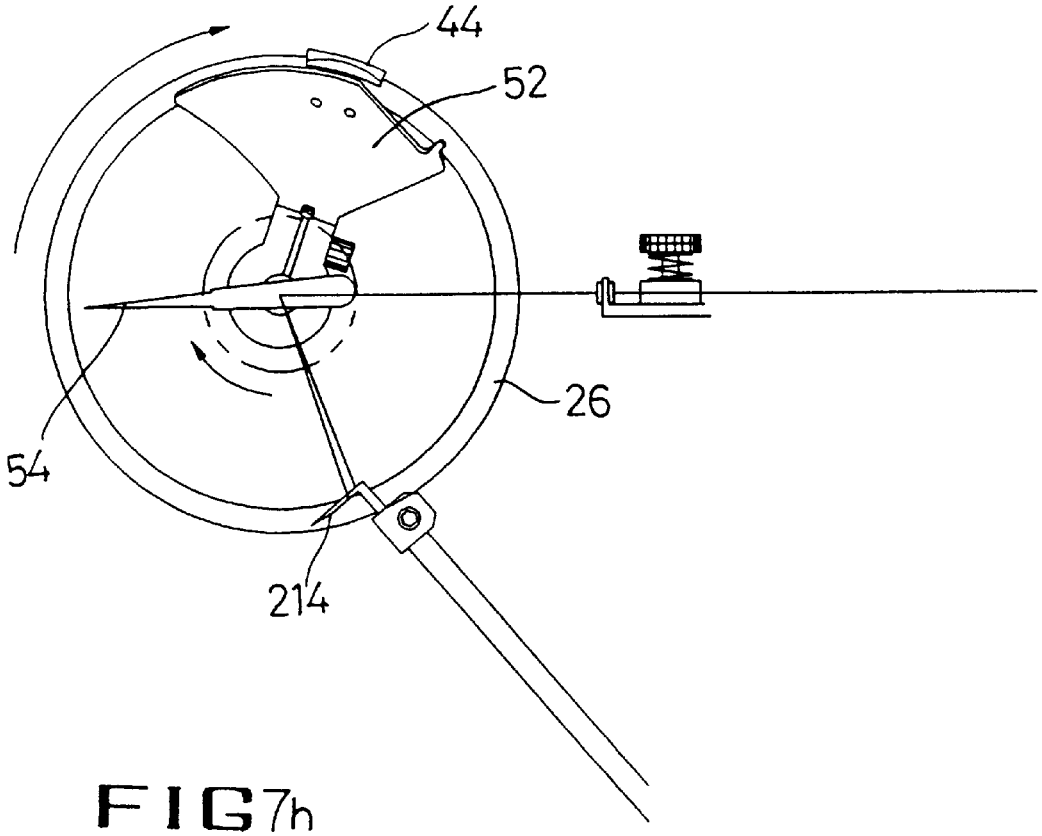
Figure 7H:
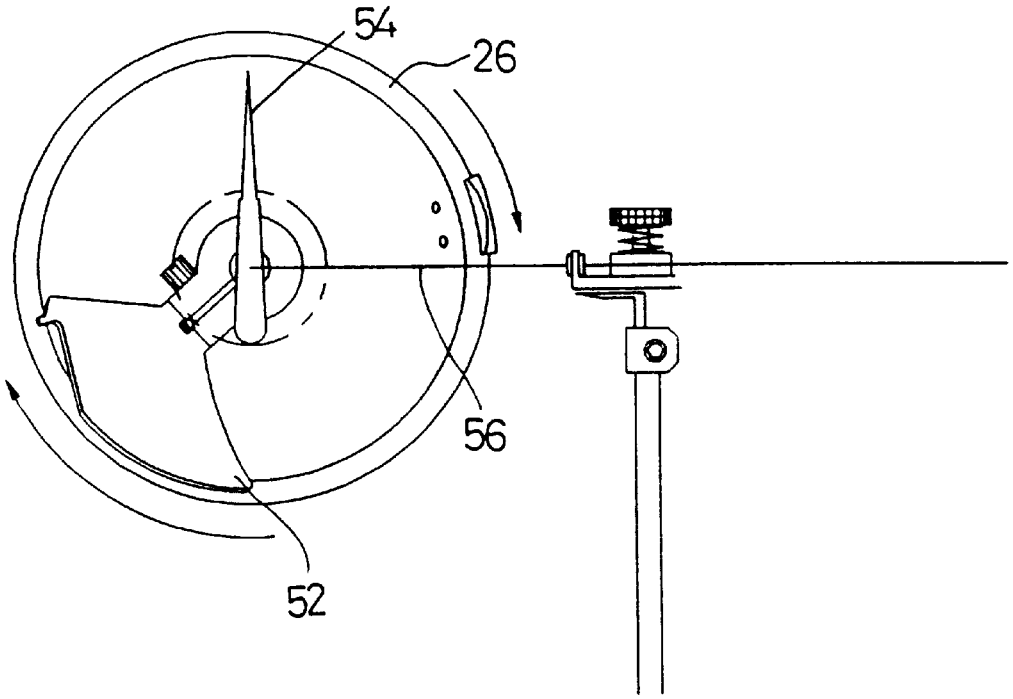

Thereafter, the thread separating member 214 rotates to move upwardly by virtue of the functions of the associated eccentric cam 212 and helical gears 306 and 306*a* and hooks the twisted binding thread 56 hooked by the twist forming member 54, as shown in FIG. 7*e*. As a result, the twisted binding thread 56 is separated from the twist forming member 54. Accordingly, the binding thread 56 is wound on the thread-fixing thread 12 in a twisted state. Thus, a secure binding for the thread-fixing thread 12 is achieved. FIG. 7*f* shows a state in which the twisted binding thread 56 is separated from the twist forming member 54 by the thread separating member 214. FIG. 7*g* shows a state in which the twisted binding thread 56 is separated from the thread separating member 214. FIG. 7*h* shows an initial state as mentioned above.

Figure 8A:
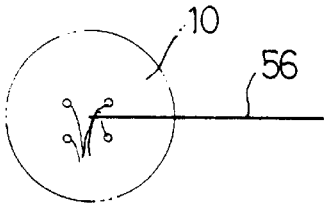
Figure 8B:
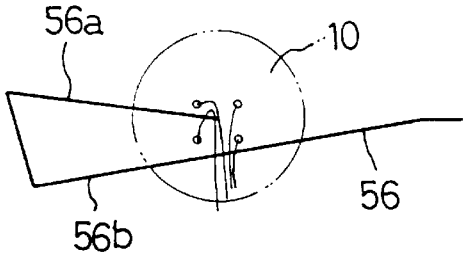
Figure 8C:
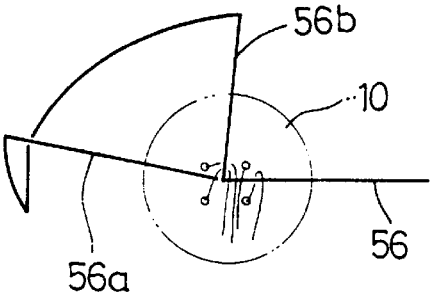
Figure 8D:
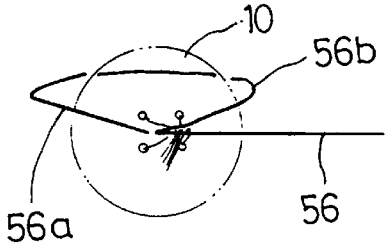
Figure 8E:
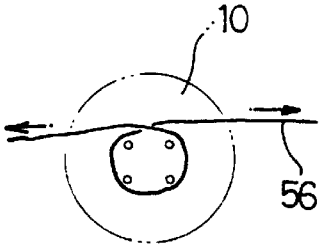
Figure 9:
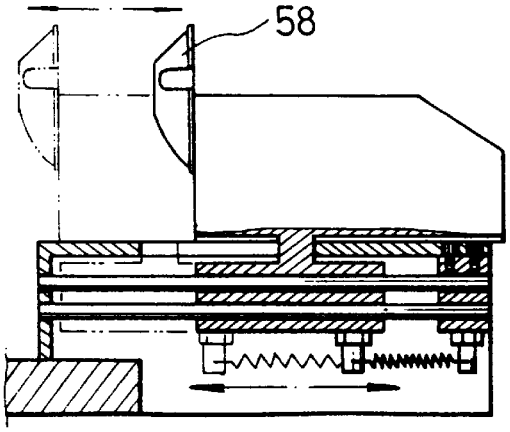
FIG. 9 is a side view illustrating a button holding die included in the apparatus of FIG. 1.

Referring to FIGS. 8*a* to 8*e*, respective states of the binding thread 56 corresponding to the sequential steps of the binding operation are illustrated. FIG. 8*a* shows an initial winding state in which the leading end of the binding thread 56 is coupled to the button 10. FIG. 8*b* shows a state, following the state of FIG. 8*a*, in which the binding thread 56 is hooked by the thread hooking plate 44 in such a manner that two strands 56*a* and 56*b* thereof are formed. FIG. 8*c* shows a state, following the state of FIG. 8*b*, in which the strand 56*b* of the binding thread 56 is hooked by the twisting member 52. The state of FIG. 8*c* corresponds to a state just preceding the formation of a complete twist with the binding thread 56. FIG. 8*d* shows a state, following the state of FIG. 8*c*, in which the twist forming member 54 hooks the strand 56*a* of the binding thread 56, thereby forming a complete twist with the binding thread 56. Finally, FIG. 8*e* shows a state, following the state of FIG. 8*d*, in which the twisted binding thread 56 is separated from the twist forming member 54 by the thread separating member 214, so that it is wound on the thread-fixing thread 12 in a twisted state.

Figure 10:
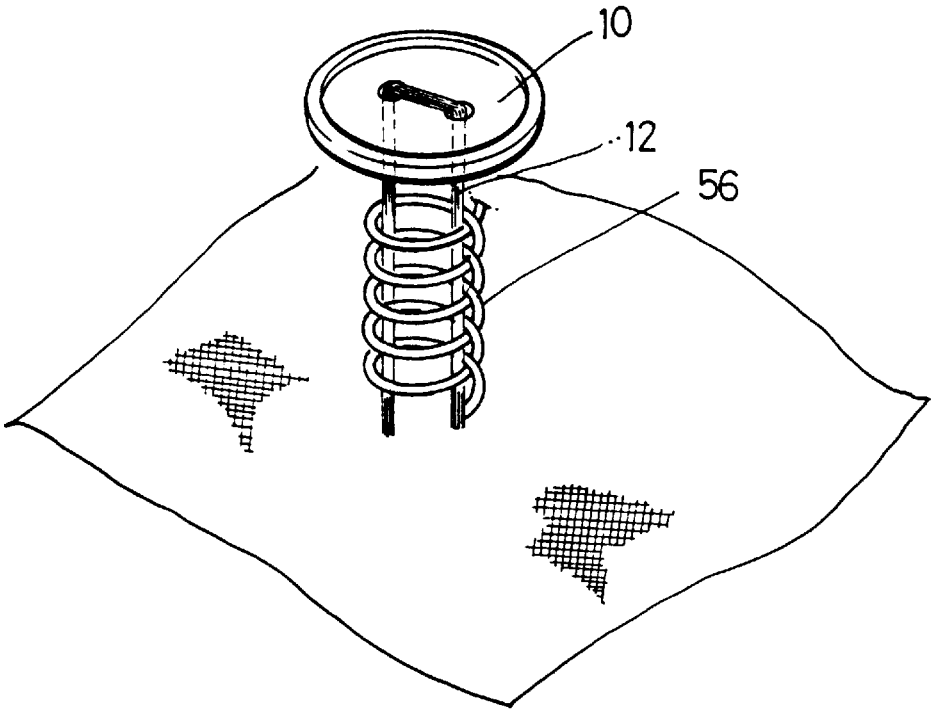
FIG. 10 is a perspective view illustrating a binding thread wound around a button-fixing thread in accordance with the present invention.
Figure 11:
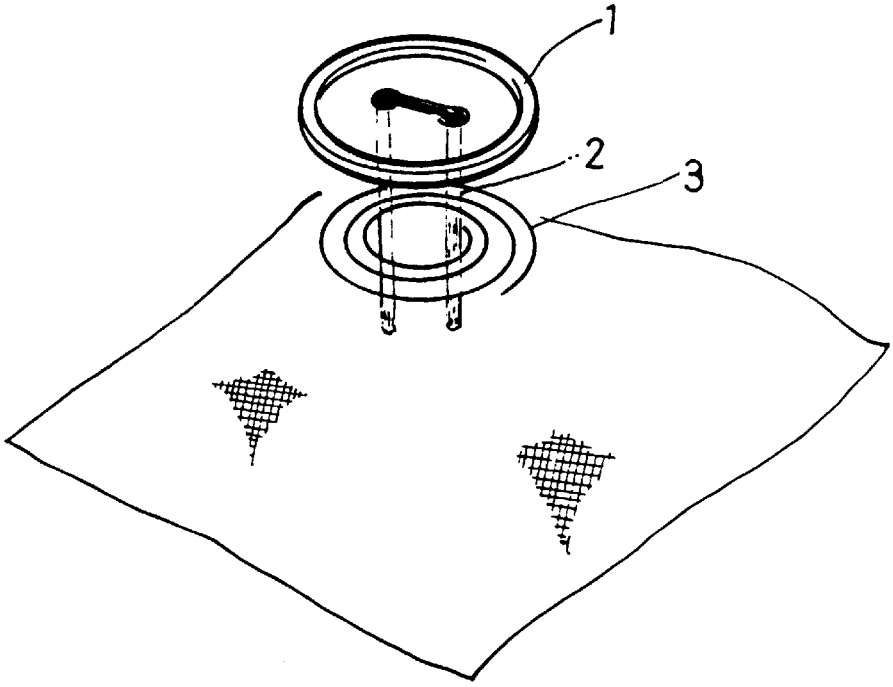
FIG. 11 is a perspective view illustrating a binding thread wound around a button-fixing thread in accordance with the prior art.

As the above mentioned binding operation is repeatedly carried out, the binding thread 56 is continuously wound around the button-fixing thread 12 while repeatedly forming twists therewith, as shown in FIG. 10. Accordingly, it is possible to prevent the button-fixing thread from being loosened, thereby preventing the button from being separated from the fabric.

As apparent from the above description, the present invention provides an apparatus for binding a button-fixing thread running through a button sewed on a garment or other fabric, which is capable of winding a binding thread around the button-fixing thread by several turns in a safe, simple, easy and convenient manner while forming a twist with the binding thread at every turn. Accordingly, it is possible to prevent the button from being separated due to a loosening of the button-fixing thread during a strong washing operation or an operation of passing the button through a button slit formed in the garment. It is also possible to achieve an improvement in the binding operation and an improvement in the reliability in use. Furthermore, an improvement in workability and productivity is obtained.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for winding a binding thread around a button-fixing thread running through a button sewed on a fabric, comprising:

a base die;

a motor fixedly mounted on the base die;

a first spur gear fixedly mounted on a main rotating shaft coupled to the motor;

a driven shaft having a second spur gear fixedly mounted thereon and connected to the first spur gear by a timing belt, the driven shaft also having a third spur gear fixedly mounted thereto, a fourth spur gear fixedly mounted thereto, and a fifth spur gear fixedly mounted thereto;

a first actuating shaft connected to the driven shaft, the first actuating shaft being of a hollow structure and having a sixth spur gear fixedly mounted thereon and engaged with the third spur gear;

a rotating shaft connected to the driven shaft, the rotating shaft having a seventh spur gear connected to the fourth spur gear by a timing belt;

an eccentric cam fixedly mounted on the rotating shaft;

a carriage fixedly mounted on the first actuating shaft and operatively connected to the eccentric cam, the carriage serving to convert a rotation of the rotating shaft into an axial reciprocal movement of the first actuating shaft;

a drum rotatably mounted on the first actuating shaft;

an eighth spur gear rotatably mounted on the first actuating shaft and connected to the fifth spur gear by a timing belt, the eighth spur gear being attached to the drum, thereby rotating the drum upon a rotation of the first actuating shaft;

a second actuating shaft axially received in the first actuating shaft, the second actuating shaft being axially fixed with respect to the first actuating shaft while rotating freely;

means for reversibly rotating the second actuating shaft;

a thread hooking plate attached to the drum opposite to the eighth spur gear at a desired portion of the periphery of the drum and adapted to hook the binding thread to be wound around the button-fixing thread when the drum rotates;

a twisting member fixedly mounted to an end of the first actuating shaft protruded from the drum, the twisting member serving to twist the binding thread hooked by the thread hooking plate and to separate the twisted binding thread from the thread hooking plate in accordance with an axial and rotating movement of the first actuating shaft after the thread hooking plate rotates by a predetermined angle;

a twist forming member fixedly mounted to an end of the second actuating shaft disposed in the vicinity of the twisting member, the twist forming member serving to hook the binding thread twisted by the twisting member in accordance with an axial and rotating movement of the second actuating shaft after the twisting member rotates by a predetermined angle, thereby forming a complete twist with the binding thread;

a thread separating member arranged in the vicinity of the twist forming member, the thread separating member serving to hook the twisted binding thread on the twist forming member after a predetermined period of time corresponding to a predetermined rotation degree of the twist forming member elapses, thereby separating the twisted binding thread from the twist forming member and winding the binding thread on the button-fixing thread;

means for reversibly rotating the thread separating member; and a button holding die arranged in front of the drum and configured to rotate while moving axially to allow a button-fixing thread to run reciprocally through a button held by the button holding die and a garment to be attached with the button.

2. The apparatus according to claim 1, further comprising a thread anti-separation bearing mounted to the drum and adapted to prevent the binding thread hooked by the thread hooking plate from being separated from the thread hooking plate during the rotation of the thread hooking plate until the twisting member completely hooks the binding thread.

3. The apparatus according to claim 1, wherein the eighth spur gear rotatably mounted on the first actuating shaft and the fifth spur gear fixedly mounted on the driven shaft have a gear ratio of 1:4.

4. The apparatus according to claim 1, wherein the fourth spur gear fixedly mounted on the driven shaft and the seventh spur gear connected to the fourth spur gear to rotate the eccentric cam have a gear ratio of 1:4.

5. The apparatus according to claim 1, wherein the operative connection between the carriage and the eccentric cam is provided by a link consisting of two bars pivotally connected to each other, the link having a connecting pin engaged with a cam groove formed on the eccentric cam while being connected at one end thereof to the carriage.

6. The apparatus according to claim 1, wherein the means for reversibly rotating the second actuating shaft comprises:

a spur gear fixedly mounted on an end of the second actuating shaft opposite to the twisting member;

an eccentric cam operatively connected to the rotating shaft, the eccentric cam having a rotation reversing function;

a reversible rotating shaft operatively connected to the eccentric cam in such a manner that it rotates reversibly in accordance with the function of the eccentric cam; and a sector gear fixedly mounted on the rotating shaft and engaged with the spur gear.

7. The apparatus according to claim 1, wherein the means for reversibly rotating the thread separating member comprises:

an eccentric cam operatively connected to the rotating shaft, the eccentric cam having a rotation reversing function;

a reversible rotating shaft operatively connected to the eccentric cam in such a manner that it rotates reversibly in accordance with the function of the eccentric cam, the reversible rotating shaft having a first helical gear fixedly mounted thereto; and an assistant reversible rotating shaft having, at one end thereof, a second helical gear fixedly mounted thereto, the assistant reversible rotating shaft being attached at the other end thereof with the thread separating member.

8. The apparatus according to claim 6, wherein the eccentric cam is configured to have the same rotation rate as the driven shaft and to rotate the sector gear after a predetermined period of time corresponding to a predetermined rotation degree of the twisting member.

9. The apparatus according to claim 7, wherein the eccentric cam is configured to have the same rotation rate as the driven shaft and to rotate the thread separating member after a predetermined period of time corresponding to a predetermined rotation degree of the twist forming member elapses, and the helical gears have a gear ratio capable of obtaining an increased rotation speed of the thread separating member.

* * * * *